US010151077B2

(12) United States Patent
Paull

(10) Patent No.: US 10,151,077 B2
(45) Date of Patent: Dec. 11, 2018

(54) APPARATUS AND METHOD FOR ENHANCED CLAMSHELL LOADER GRADING CONTROL

(71) Applicant: Phillip Paull, Noblesville, IN (US)

(72) Inventor: Phillip Paull, Noblesville, IN (US)

( * ) Notice: Subject to any disclaimer, the term of this patent is extended or adjusted under 35 U.S.C. 154(b) by 0 days.

(21) Appl. No.: 15/014,701

(22) Filed: Feb. 3, 2016

(65) Prior Publication Data

US 2016/0251823 A1 Sep. 1, 2016

Related U.S. Application Data

(60) Provisional application No. 62/121,050, filed on Feb. 26, 2015.

(51) Int. Cl.

| | |
|---|---|
| ***E02F 3/43*** | (2006.01) |
| ***E02F 3/34*** | (2006.01) |
| ***E02F 9/26*** | (2006.01) |
| ***E02F 3/40*** | (2006.01) |
| ***E02F 3/413*** | (2006.01) |

(52) U.S. Cl.

CPC ..... *E02F 3/3414* (2013.01); *E02F 3/404* (2013.01); *E02F 3/4133* (2013.01); *E02F 3/432* (2013.01); *E02F 9/265* (2013.01)

(58) Field of Classification Search

CPC . E02F 3/431; E02F 3/40; E02F 3/4133; E02F 9/265; E02F 3/3414

See application file for complete search history.

(56) References Cited

U.S. PATENT DOCUMENTS

| | | | | |
|---|---|---|---|---|
| 5,473,828 | A * | 12/1995 | Kishi | B66C 3/16 294/68.23 |
| 2013/0280021 | A1* | 10/2013 | Knuth | E02F 9/2275 414/718 |
| 2014/0178166 | A1* | 6/2014 | Andruch, III | B66C 13/18 414/743 |
| 2016/0076228 | A1* | 3/2016 | Nau | E02F 9/261 701/50 |

* cited by examiner

*Primary Examiner* — Redhwan K Mawari
*Assistant Examiner* — Rodney P King
(74) *Attorney, Agent, or Firm* — C. John Brannon; Brannon Sowers & Cracraft PC

(57) ABSTRACT

A method of operating a loader having a clamshell bucket operationally connected thereto, wherein the clamshell bucket has a first clamshell portion pivotably connected to a second clamshell portion, including positioning the first clamshell portion in contact with the ground, and automatically adjusting the angular relationship between the first clamshell portion and the second clamshell portion as the second clamshell portion is moved through the ground to maintain a predetermined grade.

8 Claims, 10 Drawing Sheets

APPARATUS AND METHOD FOR ENHANCED CLAMSHELL LOADER GRADING CONTROL

CROSS-REFERENCE TO RELATED APPLICATIONS

This patent application claims priority to U.S. Provisional Patent Application Ser. No. 62/121,050, filed on Feb. 26, 2015, all of which is incorporated herein by reference.

TECHNICAL FIELD

The present novel technology relates generally to the field of mechanical engineering, and, more particularly, to a method and apparatus for enhancing control of a digging machine using a clamshell bucket, such as to facilitate more precise and efficient excavation, to prevent digging beyond a predetermined depth, grade, or contour, and/or to maintain a predetermined desired orientation of the clamshell bucket while digging.

BACKGROUND

Digging and maintaining grade while digging with a clamshell bucket continues to be a challenge even for the most experienced operators. Clamshell buckets, once in vogue, are rarely used for precision excavation anymore due to the extended learning curve required for operators to become sufficiently proficient. Although offering unique and distinct advantages, the difficulties in becoming proficient with a clamshell bucket have discouraged their use across the digging industry.

Thus, there is a need for a system for automatically preventing overdigging and for automatically keeping the excavation on a predetermined grade, assisting an operator using a clamshell bucket. The present novel technology addresses this need.

DETAILED DESCRIPTION

Figure 1:
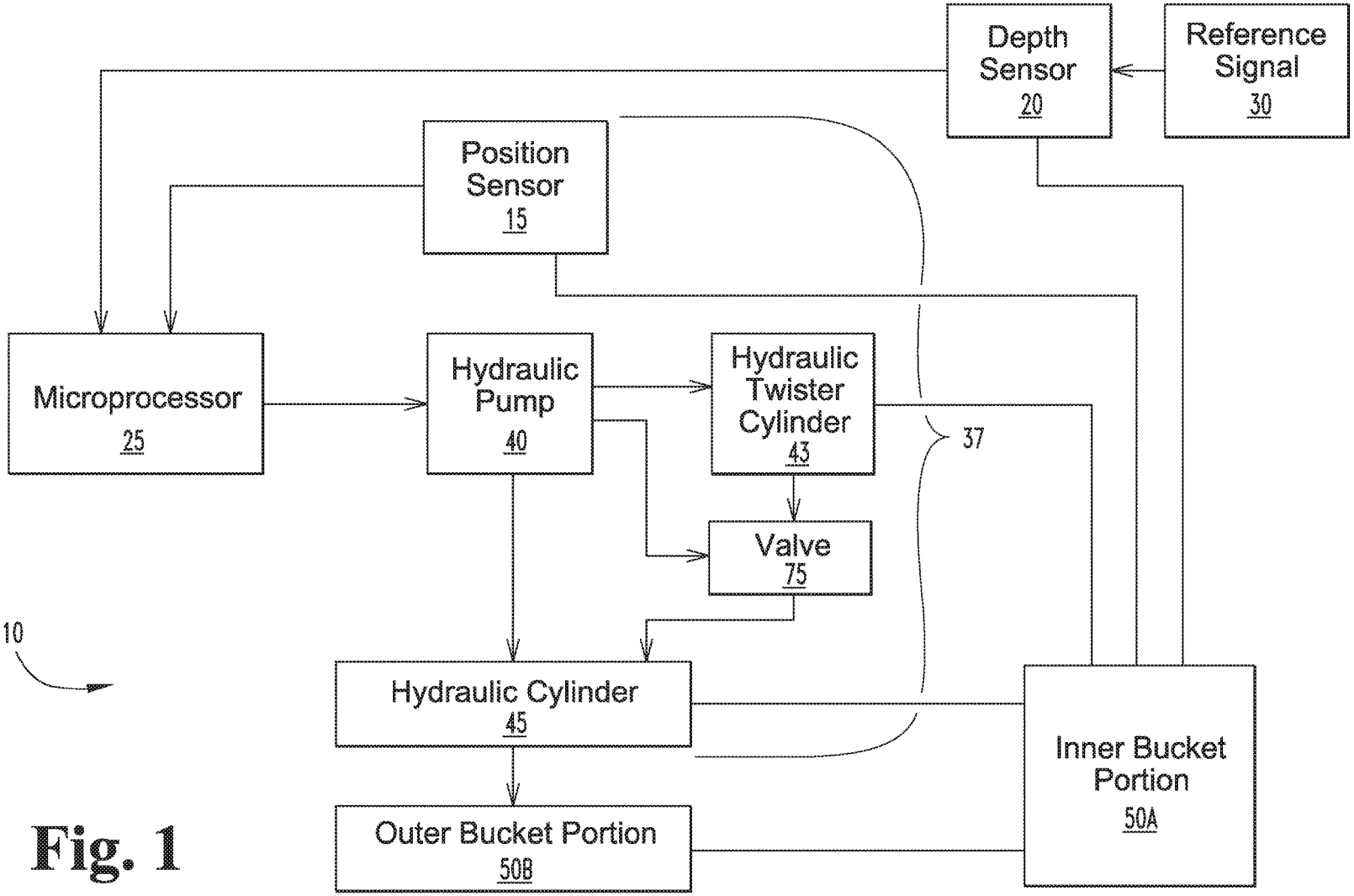
FIG. 1 is a schematic diagram of a first embodiment of the present novel technology, a system for automatically maintaining a back hoe bucket on grade during a digging operation.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

A first embodiment of the present novel technology is illustrated in FIGS. 1-6C, a system 10 for automatically preventing a clamshell or '4-in-1' bucket 50, such as attached to a skid loader from digging substantially deeper than a predetermined grade depth parameter. While the following example and drawings focus on a clamshell bucket 50 on a skid loader, the claimed novel technology is not limited to a skid steer system and includes any bifurcated bucketed digging machines. The system 10 includes a gyroscopic or angle sensor 15 operationally connected to a microprocessor 25 and likewise connected to each respective bucket portion 50A, 50B of the clamshell bucket 50. Further, some embodiments may only have a gyroscopic sensor 15, while others may only have a position sensor 20, such as a GPS sensor, for receiving a reference signal 30 may be from a GPS satellite, a laser, and/or the like.

FIGS. 1-6C illustrate a skid loader 60 equipped with the system 10 as described above, wherein the skid loader 60 has a clamshell bucket 50 having a clamshell or ski portion 50A pivotably connected to a dozer or heel portion 50B. Sensors 15 are connected to each portion 50A, 50B, and the system independently controls the movement and orientation of each portion 50A, 50B. In this example, portions 50A and 50B are pivotably connected, but in other embodiments two bucket portions 50A, 50B or independent buckets may be physically independent of one another and still simultaneously controlled by system 10.

By means of general illustration, a bucket 50 controlled by any of the above systems may continue to cut grade even if the machine or chassis 60 to which it is connected is moving, pivoting, or otherwise teetering. Movement of the bucket 50 is controlled independently of any movement of the tractor, loader or the like 60 to which the bucket 50 is connected.

FIGS. 5A-5C and 6C illustrate the system above with the clamshell bucket 50 attached to the loader 60 via a twist coupler 70, allowing the bucket 50 to be moved with additional rotational and/or transverse degrees of freedom.

The microprocessor 25 is also connected to an actuator assembly 37. The actuator assembly typically 37 includes a pressure source or pump 40, such as a hydraulic or pneumatic pump 40 connected in fluidic communication with at least one hydraulic or pneumatic cylinder 45. The fluidic cylinder 45 is fixedly, and typically pivotably, connected to the inner portion 50A of a clamshell bucket 50 and operationally connected to the outer portion 50B of bucket 50. While actuator assembly 37 is described herein as being of the pressurized piston/cylinder type, actuator assembly 37 may likewise include other types of actuators, such as mechanical, electromechanical, and/or the like.

Bucket 50 is likewise connected to a skid loader or the like. Respective gyroscopic sensors 15 are likewise operationally connected to the respective bucket portions 50A, 50B such that the depth of the cutting edge 53 of the inner portion 50A, and relative positions of each portion 50A, 50B may be directly measured and the depth of cut of bucket portion 50A calculated from the relative angle between bucket portions 50A, 50B.

Figure 2:
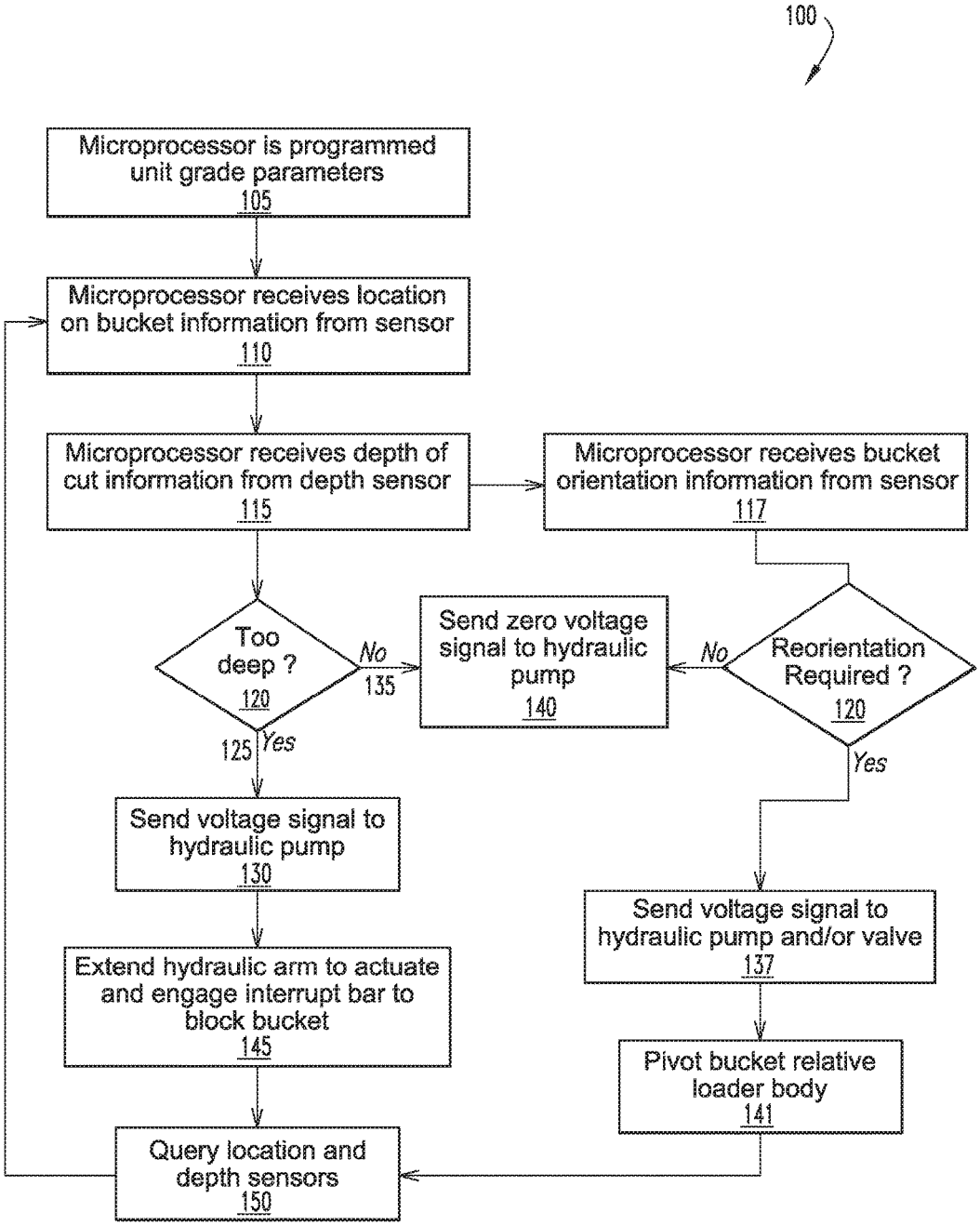
FIG. 2 is a schematic diagram of the process of FIG. 1.
Figure 3:
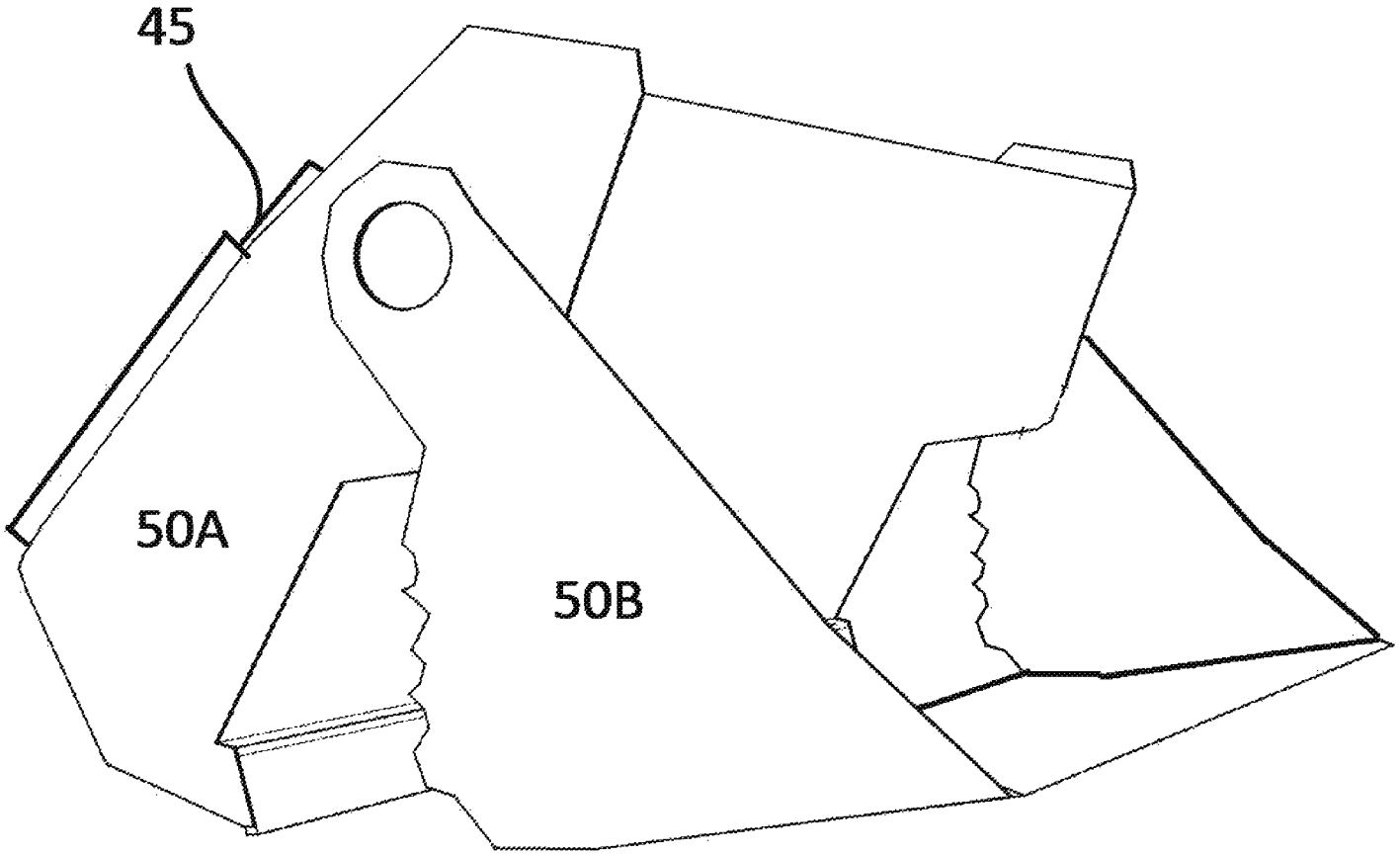
FIG. 3 is a partial perspective view of a clamshell bucket as incorporated in the embodiment of FIG. 1.
Figure 4:
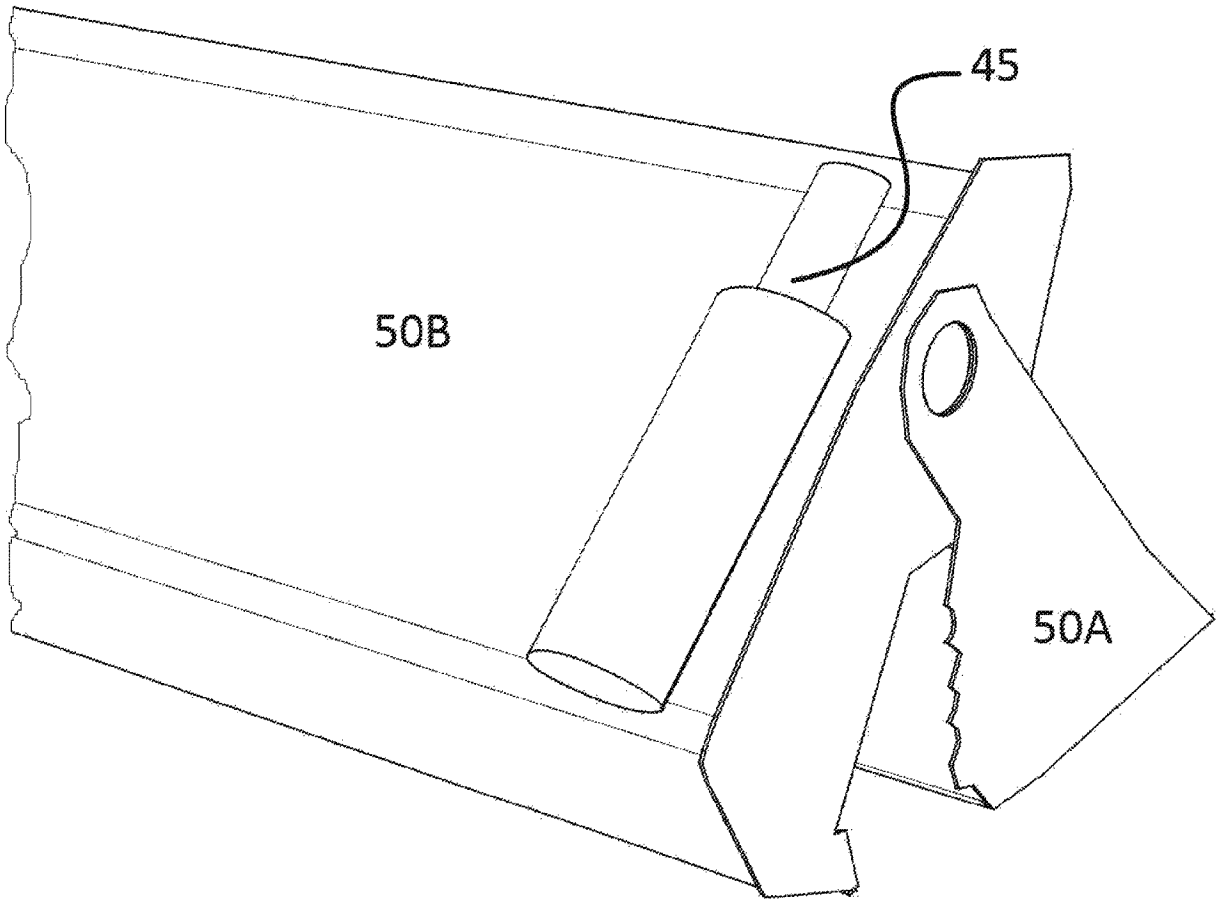
FIG. 4 is an enlarged partial perspective view of FIG. 3.
Figure 5A:
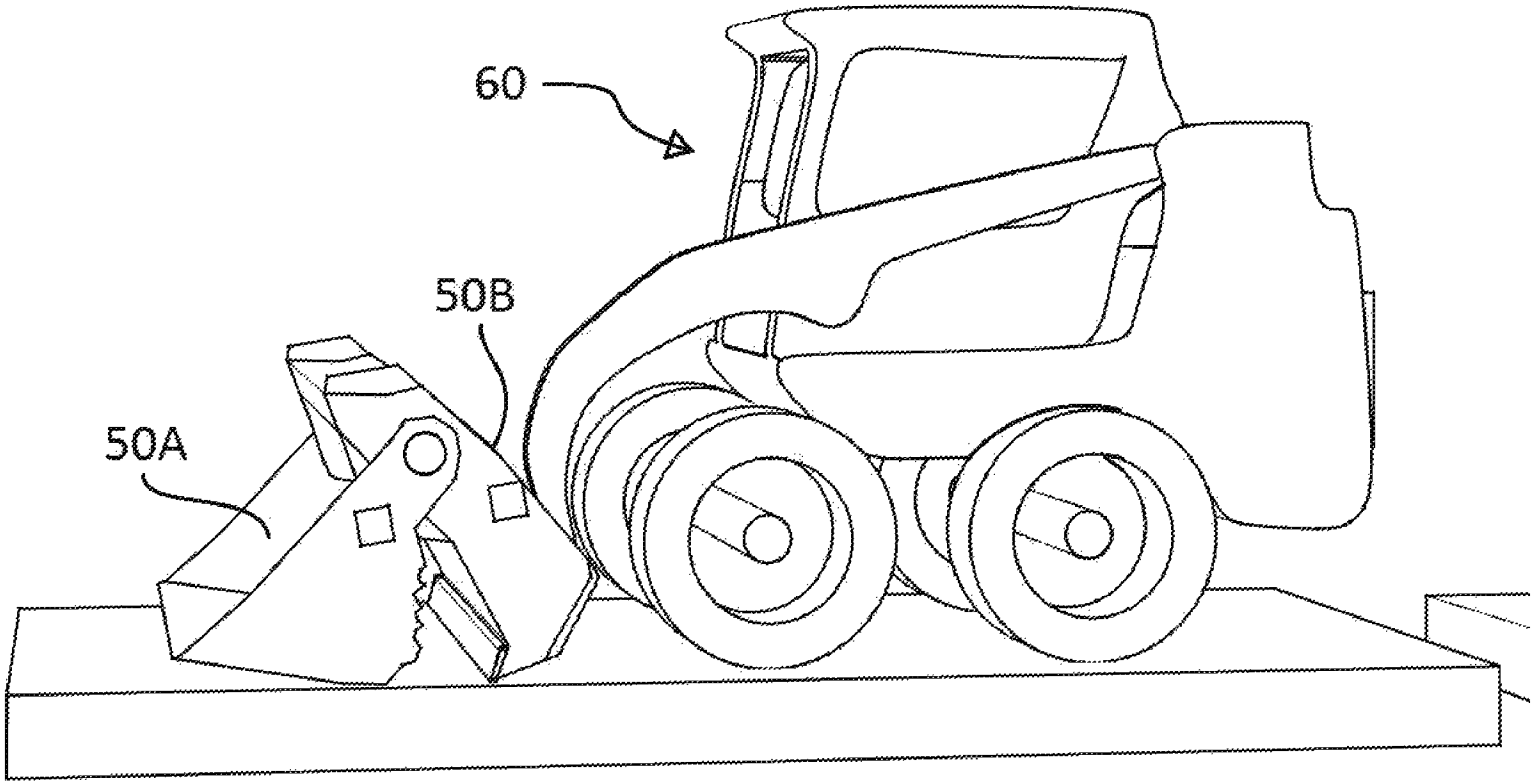
FIG. 5A a is a schematic illustration of a track loader having a clamshell bucket system with the heel in a first, neutral orientation according to another embodiment of the present novel technology.
Figure 5B:
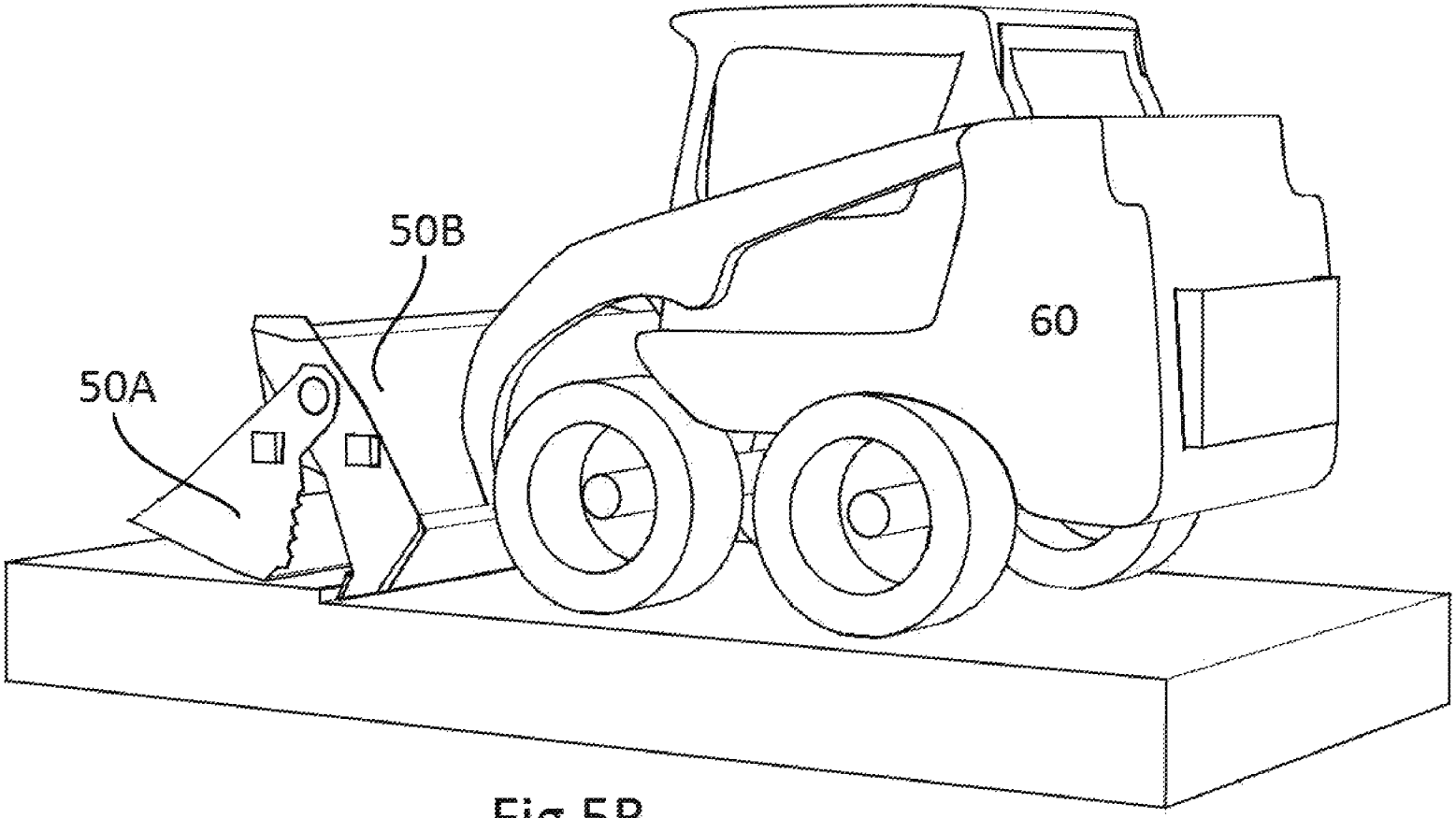
FIG. 5B a is a schematic illustration of a track loader having a clamshell bucket system with the heel in a second, ground engaging orientation according to the embodiment of FIG. 5A.
Figure 5C:
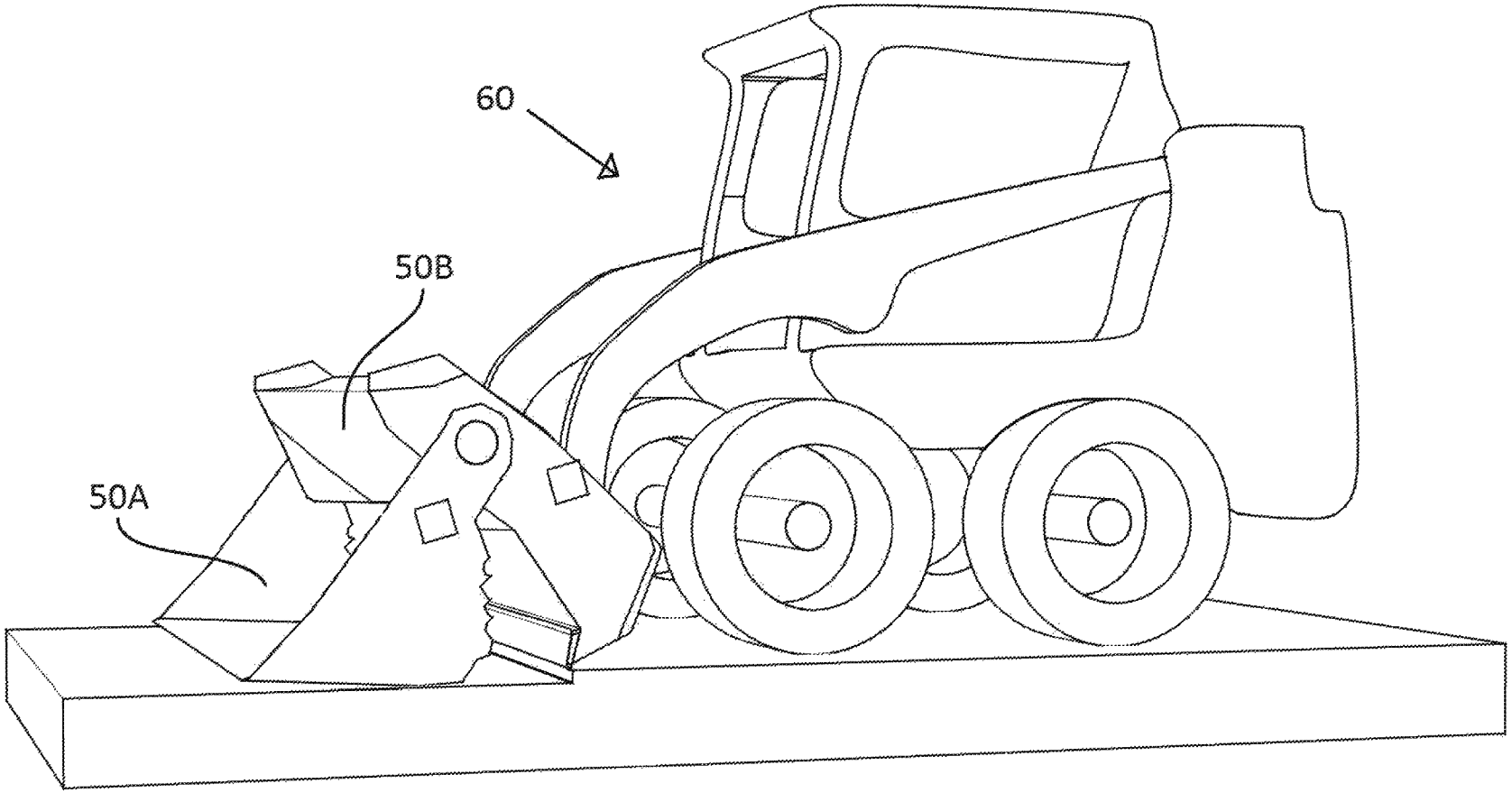
FIG. 5C a is a schematic illustration of a track loader having a clamshell bucket system with the clamshell in a third, reverse ground engaging orientation according to the embodiment of FIG. 5A.
Figure 6A:
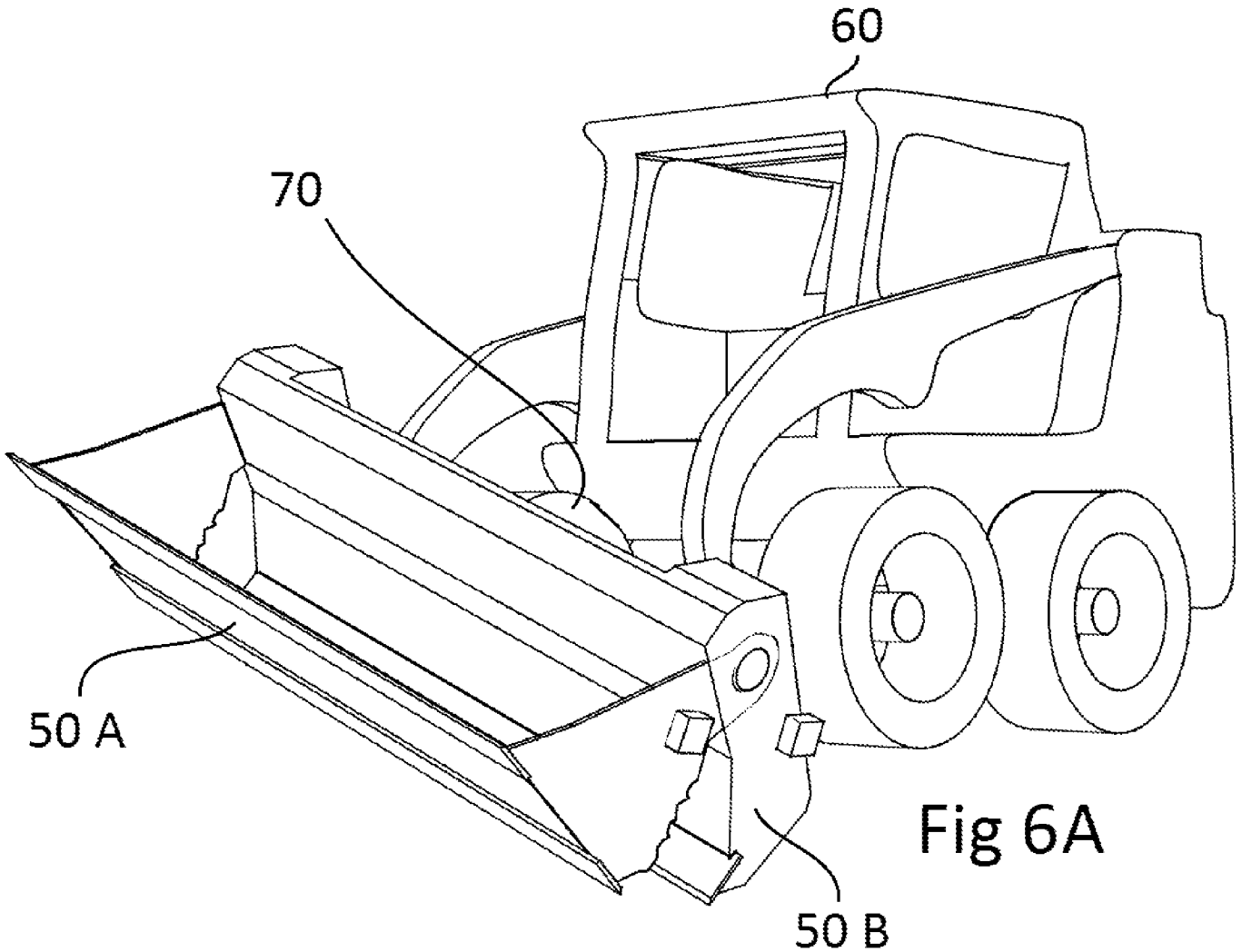
FIG. 6A is a first perspective view of the track loader of claims 5A-5C with a swiveling bucket assembly.
Figure 6B:
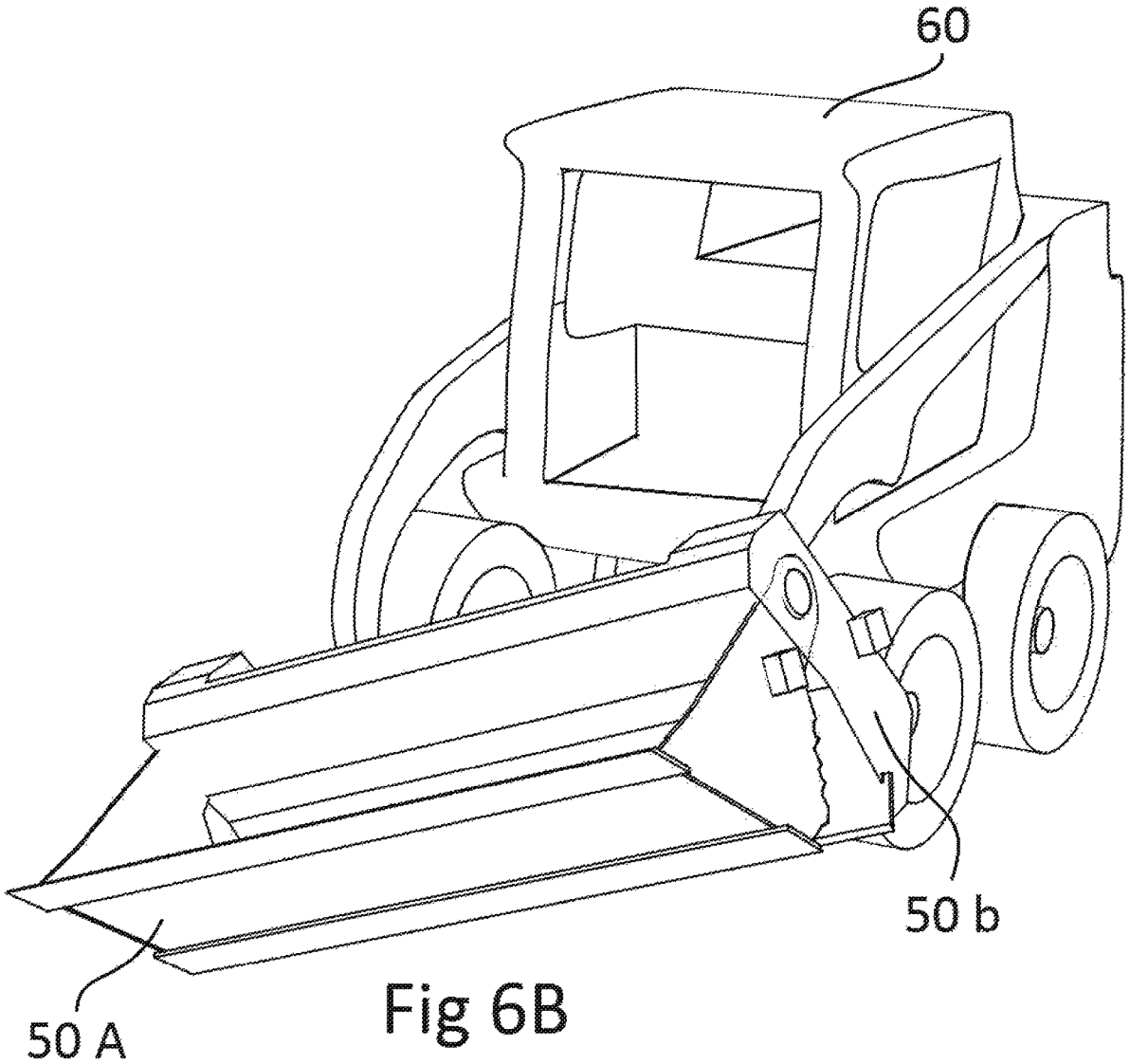
FIG. 6B is a second perspective view of the track loader of claims 5A-5C with a swiveling bucket assembly.
Figure 6C:
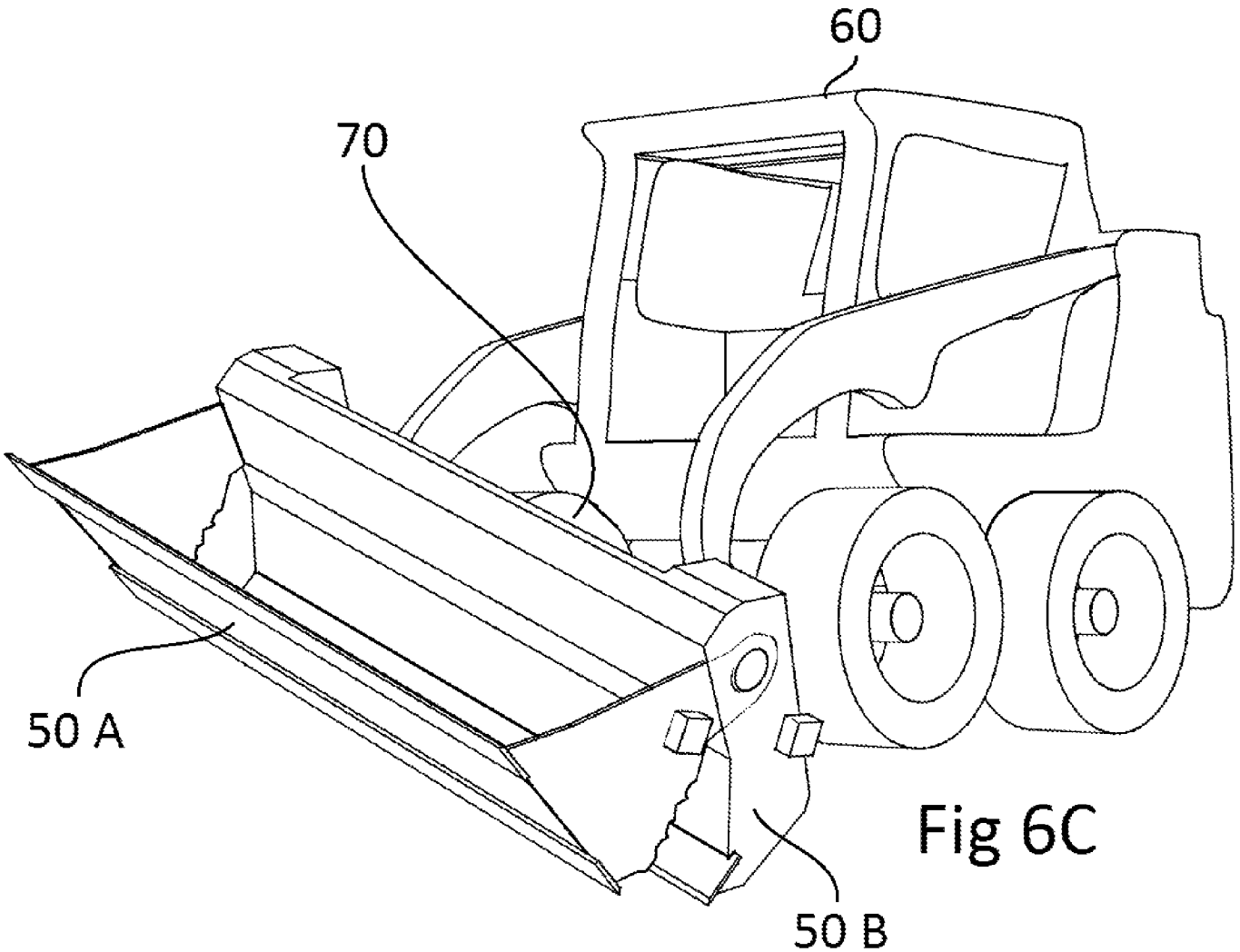
FIG. 6C is a third perspective view of the track loader of claims 5A-5C with a swiveling bucket assembly.

In operation 100, as schematically illustrated in FIG. 2, microprocessor 25 is first programmed with the ground level as determined by the position and/or orientation of the bucket portion 50B in contact with the ground location and the desired depth of cut parameters of the grade or excavation to be dug 105. The depth of the bucket 50 is calculated in substantially real-time by the relative angle between the bucket portions 50A, 50B. As the operator opens and/or shuts the bucket 50, the microprocessor 25 uses information from sensors 15 to maintain the desired angle between the bucket portions 50A, 50B to maintain the desired elevation of the cutting edge 53. The position sensors 15 are used to report or calculate 117 the orientation of the bucket 50, such as its degree of pivot relative to a predetermined base orientation, such as blade down and parallel to the horizontal. The depth, location, and orientation information are used to calculate the position of the bucket 50 and this is compared 120 by the microprocessor 25 to the programmed grade information. If the bucket 50 begins to exceed 125 programmed grade parameters, such as moving deeper than the programmed grade, an actuation signal 130, typically a voltage, is generated by the microprocessor 25 and sent to the hydraulic pump 40, energizing the pump 40 and actuating the cylinder 45 to extend 145 and pivot the bucket portion 50B into position to maintain the desired angle between itself and bucket portion 50A. Engagement of the ground by bucket portion 50B while maintaining the predetermined angular relationship between bucket portions 50A, 50B prevents bucket portion 50A from penetrating deeper into the ground than desired grade (or the reverse, expelling material from the bucket 50 into overdug areas). The microprocessor 25 may then query the sensors 15, 20 for bucket location information, and the cycle starts over. It should be noted that although the process of digging to grade is typically one of vertically removing dirt, the programmed grade may likewise be a substantially horizontal parameter, such as the walls of a dug basement. The microprocessor 25 may likewise combine vertical, horizontal, and/or bucket orientation parameters to govern the excavation of curved and/or complex shape surfaces. Likewise, if bucket 50 requires reorientation, a signal 137 is generated and sent to actuate hydraulic pump 40 and/or valve 75 to pivot 141 bucket portion 50A relative to bucket portion 50B and/or the loader body 60.

Valve 75 is operationally connected to provide power to the hydraulic actuator 45 and control over the bucket portions 50A, 50B. Sensors 15, 20 are operationally connected to an electronic controller 25 and are positioned on bucket portions 50A, 50B to yield information regarding the position and motion of predetermined points on portions 50A, 50B from which the position, orientation, and/or motion of the bucket 50 may be determined. The electronic controller 25 is connected in electric communication with a display portion and, typically, a joystick or like control interface. While the display portion may typically be a screen (e.g., LCD, OLED, etc.) or the like, the system 10 may also use a push button or other input means to indicate and/or input settings or choices. For example, a button may illuminate or pulse green when in operation, red when waiting for confirmation or input, and/or orange when approaching an obstacle. Further, pressing a button in a specific manner may trigger a variety of routines. For example, pressing the button once in a predetermined time period may initiate a first digging/grading sequence, pressing twice may trigger a different sequence, holding down the button may halt operation, etc.

The sensors 15 are typically gyroscopic, but may be angle sensors, line sensors, accelerometers, inclinometers, gyroscopes, combinations thereof, and/or the like. Sensors 15 are typically placed on the respective bucket portions 50A, 50B, and/or the chassis 63, but may also be attached to any other fixable point of the digging machine and system 10. The chassis sensor 15, 20 may provide may provide the system 10 with a variety of relative motive and orientative data (e.g., relative X and Y coordinates, longitude, latitude, pitch, tilt, yaw, acceleration, humidity, wind speed, etc.). In some implementations, the sensors 15 (e.g., located on the chassis) may also operate in conjunction or in addition to an external, relative positioning component (e.g., a robotic control station and a robotic control station sensor) to provide location and/or motive data. Typically, the sensors 15 have a lag time of less than 0.4 seconds, more typically less than 0.1 seconds, and still more typically less than 0.05 seconds.

The electronic controller 25 is programmed to receive input from the sensors 15, 20 and maintain the bucket portions 50A, 50B in a predetermined orientation relative to one another, such as defining a predetermined angle, as the bucket 50 is moved to dig toward a desired grade, either by moving the bucket 50 toward or away from the tractor portion 60 or by moving the bucket 50 and tractor portion 60 together. For a horizontal trench, bucket portion 50B is typically maintained in contact with the surface of the ground, as is the tractor portion 60, and the angle between bucket portions 50A, 50B is varied to urge the cutting edge 53 of bucket portion 50A into the ground a predetermined distance to cut the desired grade level as the bucket 50 is pulled toward the tractor chassis 63.

The system 10 offers the advantages of reducing new operator learning curve, being able to dig out of the operator's line of sight (e.g., underwater or blocked by earth), utilizing the full stroke of the excavator to significantly reducing the need to reposition machine, thus saving significant time and fuel, and allowing the excavator to run by remote control. In addition, the flat bucket technique provides the ability to hold and follow grade with the tractor in motion, similar to dozer operation. The present novel system 10 added to the dipper stick allows for complex autoroutines and the operator has the ability to follow sculpted, complex three-dimensional surfaces.

In another example, a tractor 60, typically a skid loader, is pivotably connected to bucket 50 via a hydraulic twist coupler 70. The bucket 50 may then be tilted or pivoted, such as by energizing the hydraulic twist coupler 70 operationally connected to the bucket and to the tractor 60. This addition may allow the system 10 to more precisely or more efficiently create, or perform operations on, sloped surfaces. For example, an operator may use such a system 10 with a diagonal tilt to precisely grade a roadside embankment while also maintaining a 40° angle tilt (rolled) orientation. Alternatively, the system 10 may be used to grade a continuous slope for the crown of a roadbed, even when the road is not in a straight line.

Another implementation of the system 10 may allow for precise grading while the tractor 60 is in motion. Because the system 10 allows for 'steering' and grading relative to the inner bucket portion 50A, instead of relative to the tractor 60 (as is currently done), the motion of the tractor 60 is no longer the reference point for a grading system or a grading system operator. For example, if a one-inch-deep, fifty-foot-long, flat grade (relative to sea level) was desired, a traditional skid loader would typically remain stationary, lower and retract the bucket 50 to excavate, curl the sediment up into the bucket 50, raise the bucket 50 from the excavation site, and dump the sediment outside of the excavation site. This process would be repeated many times until the entire fifty-foot grade was complete and would oftentimes result in digging either too shallow (requiring redigging) or below grade (requiring refilling). This process is inefficient and uneconomical. Further, the traditional method typically requires an additional indication system or spotter to tell the operator where to dig. The present novel technology allows for the bucket 50A to be lowered, aligned to the desired angle relative bucket portion 50B, and then, while remaining in that position, moved through the substrate as the tractor 60 itself moves. The result is an excavation that substantially meets the desired specifications (i.e., one-inch-deep, fifty-feet-long, flat grade), typically eliminates the need for an additional indicator or spotter, and is vastly more efficient and economical than the traditional method. In another example, the bucket 50 may hover just above a substrate (i.e., the operator desires the grade to be at that elevation) and, as the tractor 60 moves forward the bucket 50 grades the substrate at an equal and/or predefined grade. Such a configuration may, for instance, be desirable in creating roadbeds, snow beds, and/or obstacles. In effect, this combination with the system 10 allows a motive loader very quickly and efficiently grade.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

I claim:

1. A digging machine, comprising:

a loader portion;

a twist coupler operationally connected to the loader portion;

a clamshell bucket operationally connected to the twist coupler, wherein the clamshell bucket further comprises a first clamshell portion and a second clamshell portion pivotably connected to the first clamshell portion and disposed between the loader portion and the first clamshell portion;

first and second gyroscopic sensors, wherein each respective gyroscopic sensor is connected to a respective clamshell portion;

a bucket hydraulic piston portion operationally connected to the first and second clamshell portions;

a hydraulic twist coupler portion operationally connected to the clamshell bucket;

a hydraulic fluid source operationally connected to each respective hydraulic portion;

a hydraulic valve operationally connected to the bucket hydraulic piston portion and to the hydraulic fluid source; and a microprocessor operationally connected to the respective sensors, the hydraulic fluid source and the valve wherein the microprocessor may be engaged to assist movement of the clamshell bucket through a predetermined digging profile; and wherein the microprocessor is operable to:

initialize the digging machine;

calibrate the digging machine;

initialize excavation;

monitor excavation;

adjust the angular relationship between the respective bucket portions such that the respective bucket portions maintain grade during digging to grade, grading, and excavation; and halt excavation.

2. The digging machine of claim 1, wherein the microprocessor is operable to maintain a predetermined angular relationship between the first and second bucket portions.

3. The digging machine of claim 1, wherein the microprocessor is further operable to:

calculate an elevation and an angle of the second bucket portion relative to the first bucket portion to determine an excavation depth;

control the second bucket portion to a predetermined excavation depth during movement of the clamshell bucket;

initialize the hydraulic valve; and actuate the bucket hydraulic piston portion.

4. The digging machine of claim 1, wherein the microprocessor is further operable to control the hydraulic twist coupler portion to maintain a predetermined tilt of the clamshell bucket relative to the loader portion.

5. The digging machine of claim 1 wherein the loader portion is a skid loader.

6. An excavation machine, comprising:

a skid loader portion;

a hydraulic twist coupler operationally connected to the skid loader portion;

a clamshell bucket operationally connected to the twist coupler, wherein the clamshell bucket further comprises a first clamshell portion and a second clamshell portion pivotably connected to the first clamshell portion and disposed between the skid loader portion and the first clamshell portion;

first and second gyroscopic sensors, wherein each respective gyroscopic sensor is connected to a respective clamshell portion;

a first hydraulic piston operationally connected to the first and second clamshell portions;

a hydraulic fluid source operationally connected to the first hydraulic piston and to the hydraulic twist coupler;

a hydraulic valve operationally connected to the first hydraulic piston and to the hydraulic fluid source; and a microprocessor operationally connected to the respective sensors, the hydraulic fluid source and the valve;

wherein the clamshell bucket may be actuated to dig grade when the skid loader and the clamshell bucket are moving forward together.

7. A digging assembly, comprising:

a loader portion;

a clamshell bucket pivotably connected to the loader portion, wherein the clamshell bucket further comprises a first clamshell portion and a second clamshell portion pivotably connected to the first clamshell portion and disposed between the loader portion and the first clamshell portion;

first and second gyroscopic sensors, wherein each respective gyroscopic sensor is connected to a respective clamshell portion;

a bucket hydraulic piston operationally connected to the first and second clamshell portions;

a twist hydraulic coupler operationally connected to the clamshell bucket;

a hydraulic fluid source operationally connected to each respective hydraulic piston;

a hydraulic valve operationally connected to the bucket hydraulic piston portion and to the hydraulic fluid source; and a microprocessor operationally connected to the respective sensors, the hydraulic fluid source and the valve;

wherein the twist hydraulic coupler and the bucket hydraulic piston are separate;

wherein the microprocessor is capable of controlling the respective clamshell portions to engage in digging to grade, grading, and excavation operations.

8. The assembly of claim 7 wherein the loader portion is a skid loader.

* * * * *